US007187296B2

(12) United States Patent
Luberda et al.

(10) Patent No.: US 7,187,296 B2
(45) Date of Patent: Mar. 6, 2007

(54) MINIATURE FAULT INDICATOR

(75) Inventors: Stanley Luberda, Cary, IL (US); John Popoolapade, Bolingbrook, IL (US); Donald Lee Donavon, McHenry, IL (US)

(73) Assignee: L-3 Communications, Electrodynamics, Inc., Rolling Meadows, IL (US)

( * ) Notice: Subject to any disclaimer, the term of this patent is extended or adjusted under 35 U.S.C. 154(b) by 216 days.

(21) Appl. No.: 11/083,905

(22) Filed: Mar. 18, 2005

(65) Prior Publication Data

US 2006/0220896 A1 Oct. 5, 2006

(51) Int. Cl.
*G08B 5/00* (2006.01)
*H01H 9/00* (2006.01)

(52) U.S. Cl. ..... 340/815.4; 340/3.22; 340/547; 340/691.7; 335/1; 335/2; 335/205; 116/204

(58) Field of Classification Search ..... 340/815.4, 340/3.43, 3.22, 691.7, 547; 335/1, 2, 21, 335/205

See application file for complete search history.

(56) References Cited

U.S. PATENT DOCUMENTS 2,373,587 A * 4/1945 Martin-Hurst ..... 335/166
3,605,047 A * 9/1971 Kasahara ..... 335/1
3,671,900 A 6/1972 Loughran, Jr. ..... 335/272
4,709,654 A * 12/1987 Smith ..... 116/283
6,305,313 B1 * 10/2001 Cunkelman et al. ..... 116/218
6,357,384 B1 * 3/2002 Laymon et al. ..... 116/281

* cited by examiner

*Primary Examiner*—Donnie L. Crosland
(74) *Attorney, Agent, or Firm*—Jones Day

(57) ABSTRACT

A rugged, miniature, waterproof and lightweight magnetic latching indicator with an auxiliary switch. The indicator includes a solenoid, an elongated plunger mounted in the solenoid, the plunger supporting a first permanent magnet with the magnet being surrounded by specially dimensioned non-magnetic spacers. The plunger and solenoid are packaged in a non-magnetic housing with a solenoid locator, a top cap and a bottom cap maintaining the indicator in a compact waterproof package. An indicator button is mounted to the plunger and a reed switch biasing spring and second permanent magnet are located between the bottom cap and the solenoid. The plunger moves from a retracted latching position to an extended position. In the retracted position, the indicator button is retracted and not readily visible and the second permanent magnet maintains the reed switch in a closed position. In the extended position, the indicator button is readily visible and the second permanent magnet is spaced from the reed switch causing the reed switch and any external circuitry connected in series with the reed switch to open.

18 Claims, 3 Drawing Sheets

MINIATURE FAULT INDICATOR

CROSS REFERENCE TO RELATED APPLICATIONS

Not applicable.

STATEMENT REGARDING FEDERALLY SPONSORED RESEARCH

Not applicable.

BACKGROUND OF THE INVENTION

1. Field of the Invention

The present invention relates to a miniature fault indicator and more particularly to a miniature indicator that senses fault signals and provides a clear visual indication of the condition of the equipment being monitored, the indicator being very small and lightweight and yet extremely rugged for use on high performance aircraft.

2. Description of the Related Art

Detection and notification of problems in potentially dangerous systems are desirable safety objectives. This is especially true of systems in an aircraft. For example, it is believed that excessive voltage in an aircraft's fuel tank poses a dangerous risk of explosion.

Devices, called fault indicators, exist. These usually indicate a fault by causing a light to illuminate or by the rotation of an alternately colored disk or drum. See for example U.S. Pat. No. 3,671,900.

Fault indicators for harsh or demanding environments, such as aircraft, and high performance military aircraft in particular, are difficult to create. Attempts to scale down mechanical devices like circuit breakers have failed because as mechanical devices shrink, friction between movable parts becomes relatively large and difficult to overcome and small and thin parts tend to be too weak to function or are easily fatigued when exposed to high G forces and vibration, commonly experienced in aircraft. Also, large temperature and pressure variations are difficult for very small mechanical devices to handle.

BRIEF SUMMARY OF THE INVENTION

The difficulties encountered with the above mentioned problem and previous devices have been over come by the present invention. What is described here is a miniature lightweight latching indicator including a housing, an electromagnetic structure in electrical communication with an external circuit and adapted to receive an electrical signal, the electromagnetic structure being mounted to the housing and including a first latching structure, a second latching structure mounted in the housing and being spaced from the first latching structure, a permanent magnet movable between a first position where the permanent magnet is in magnetic communication with the first latching structure and, in response to the electrical signal, to a second position where the permanent magnet is in magnetic communication with the second latching structure and an indicator connected to the permanent magnet where the indicator is retracted into the housing where the indicator is not readily visible when the permanent magnet is in its first position and the indicator extending out from the housing where the indicator is readily visible when the permanent magnet is in its second position.

Another embodiment of the invention includes a housing, the electromagnetic structure, the first latching structure, the second latching structure, the permanent magnet and the indicator, and in addition, includes a reed switch which may be connected to the external circuit, a second permanent magnet and a biasing spring. When the permanent magnet is in its first position, the biasing spring is compressed and the second permanent magnet causes the reed switch to be in a closed position. However, when the permanent magnet moves to its second position, the second permanent magnet is biased away from the reed switch causing the reed switch to open.

There are a number of advantages, features and objects achieved with the present invention which are believed not to be available in earlier related devices. For example, several advantages are that the fault indicator of the present invention is very small, lightweight, waterproof and rugged. Another advantage is that the indicator is reliable. Another object of the present invention is that the fault indicator provides a clear visual indication of the operational status of equipment being monitored by the fault indicator.

A complete understanding of the present invention and other objects, advantages and features thereof will be gained from a consideration of the present specification which provides a written description of the invention, and of the manner and process of making and using the invention, set forth in such full, clear, concise, and exact terms as to enable any person skilled in the art to which it pertains, or with which it is most nearly connected, to make and use the same in compliance with Title 35 U.S.C. section 112 (first paragraph). Furthermore, the following description of preferred embodiments of the invention read in conjunction with the accompanying drawing provided herein represent examples of the invention in compliance with title 35 U.S.C. section 112 (first paragraph), but the invention itself is defined in the Claims section attached hereto.

DETAILED DESCRIPTION OF PREFERRED EMBODIMENTS OF THE INVENTION

Figure 3:
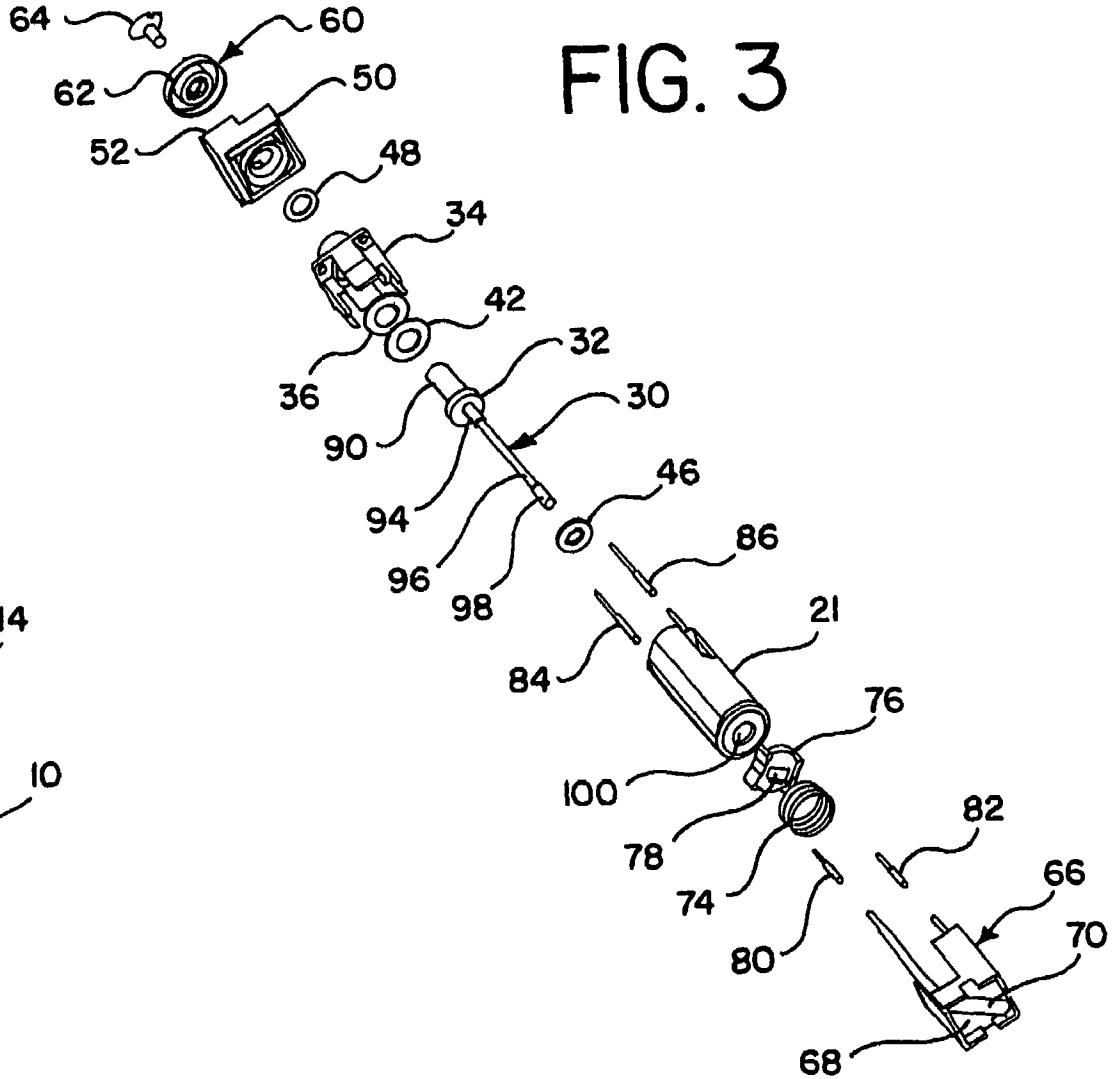
FIG. 3 is an exploded isometric view of the miniature fault indicator without an outer housing.
Figure 2:
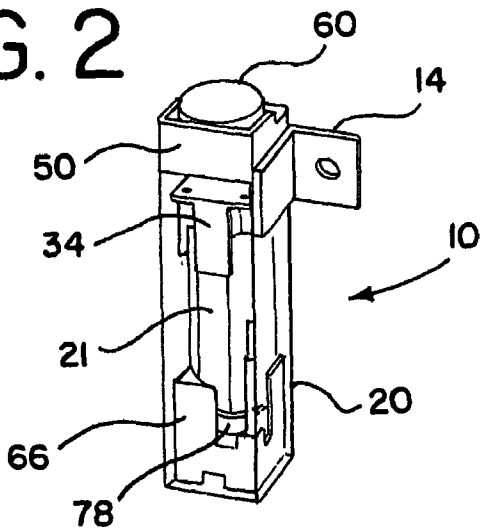
FIG. 2 is an isometric view of the miniature fault indicator with a transparent outer housing.

While the present invention is open to various modifications and alternative constructions, preferred embodiments illustrating the best mode contemplated by the inventors of carrying out their invention are shown in the various figures of the drawing and will be described herein in detail, pursuant to Title 35 U.S.C. section 112 (first paragraph). It is understood, however, that there is no intention to limit the invention to the particular embodiments, forms or examples which are disclosed herein. To the contrary, the intention is to cover all modifications, equivalent structures and methods, and alternative constructions falling within the spirit and scope of the invention as expressed in the appended Claims section attached hereto, pursuant to Title 35 U.S.C. section 112 (second paragraph).

The miniature fault indicator described below is extremely small and lightweight and yet is very robust and rugged enabling the indicator to operate in harsh environments such as in high performance military and commercial aircraft.

Figure 1:
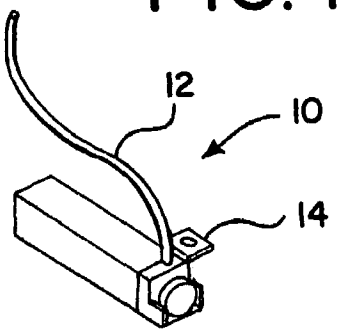
FIG. 1 is an isometric view of a miniature fault indicator.
Figure 5:
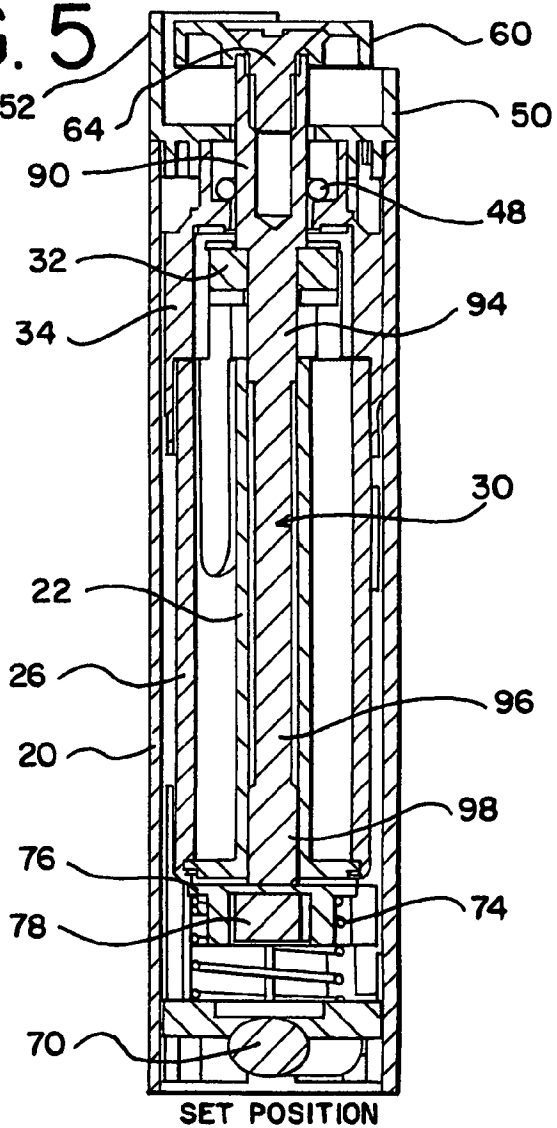
FIG. 5 is an enlarged sectional elevation view of the miniature fault indicator in a raised or set position.

The miniature fault indicator 10, FIG. 1, may include wire leads 12 and an attachment angle 14. As shown, the indicator 10 is in a "set" or raised position in which a white band is clearly observable and indicates that a fault signal has been received by the indicator. The outer dimensions of the indicator are quite small with a length of less than one and a half inches, about 1.38 inches, a width of about 0.315 inches and a depth of about 0.335 inches. The entire indicator weighs about 0.35 ounces or about 10 grams. It should be noted that other electrical leads may be used, such as conductive pins, and other attachment devices may be used depending upon the manner of mounting the indicator.

Referring now to FIGS. 2–5, the miniature fault indicator 10 is packaged in a non-electrically conducting, non-magnetic outer housing 20. The indicator includes an electromagnetic structure in the form of a solenoid 21 having a tubular core 22, a coil 24 and an inner housing 26. The core 22 may also act as a first or lower latching structure. Mounted in the core may be an elongated plunger 30 to which may be mounted a first or latching permanent magnet 32. Connected to the core, coil and inner housing may be a solenoid locator 34. Mounted to the locator 34 is a second or upper latching structure in the form of a metal washer-shaped latching plate 36. Mounted to an upper side 40 of the latching magnet 32 may be a first or upper washer-shaped synthetic resin spacer 42 and mounted to a lower side 44 of the latching magnet 32 may be a second or lower washer-shaped synthetic resin spacer 46. Also mounted in the locator 34 may be an O-ring 48.

Above the locator 34 may be a top cap 50 having a back drop wall 52. Mounted to the plunger 30 and extending through the top cap 50 may be a washer-shaped indicator button 60 having an outer annular surface 62 coated with a highly visible color band. A screw fastener 64 may be used to attach the indicator button 60 to the plunger 30. A bottom cap 66 may be located below the solenoid 21. Mounted below a wall 68 of the bottom cap 66 may be an auxiliary reed switch 70. Mounted above the bottom cap wall 68 may be a coiled spring 74, a magnet carrier 76 and, in the magnet carrier, a second or reed switch permanent magnet 78. A pair of electrical conductors 80, 82 extends from the reed switch 70 and another pair of electrical conductors 84, 86 extends from the coil 24. The solenoid, the plunger, the latching plate, the spacers and the button are mounted within the outer housing and between the top cap, the locator and the bottom cap.

The elongated plunger 30 includes a head portion 90 with a fastener receiving opening 92, a support portion 94 for engaging the permanent magnet, a small diameter shaft portion 96 and a foot portion 98. Both the support and foot portions act as bearings for supporting the plunger within a central opening 100 of the core.

The spacers 42, 46 may be made of Teflon and have specific thicknesses so that the latching magnet 32 is spaced from the core 22, the lower latching structure, and from the upper latching plate 36 by predetermined distances as a function of the strength of the latching magnet 32. The screw fastener 64 is provided to fasten the indicator button 60 to the head portion 90 of the plunger 30. The O-ring 48 may be mounted in the locator 34 in a position around the head portion 90 of the plunger to prevent moisture, humidity or particulate matter from entering the interior of the housing to interfere with the operation of the latching magnet.

Figure 4:
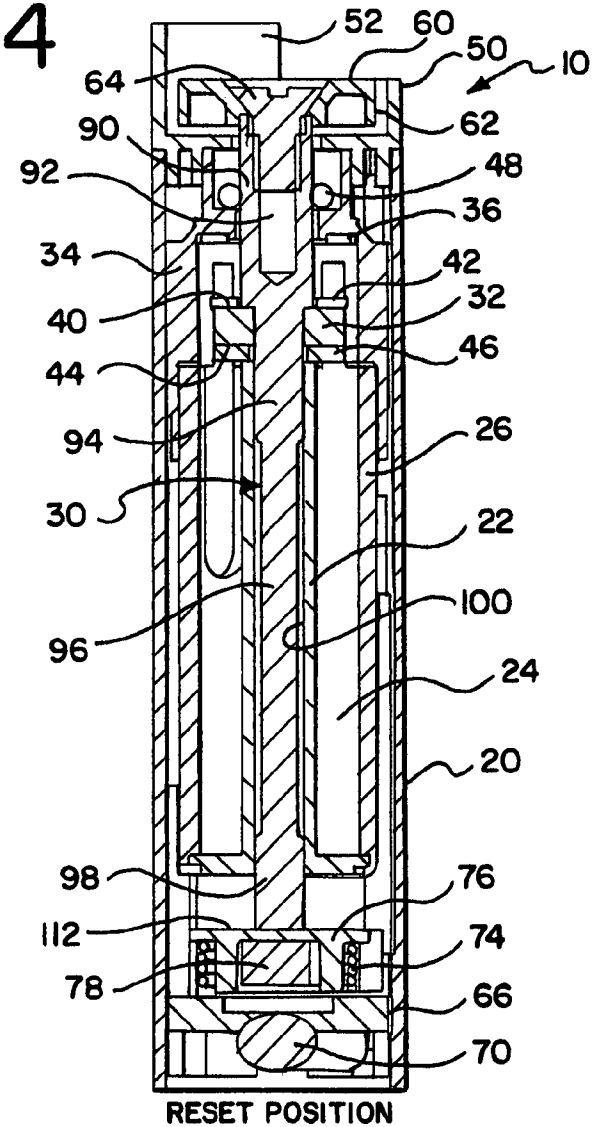
FIG. 4 is an enlarged sectional elevation view of the miniature fault indicator in a retracted or reset position.
Figure 6:
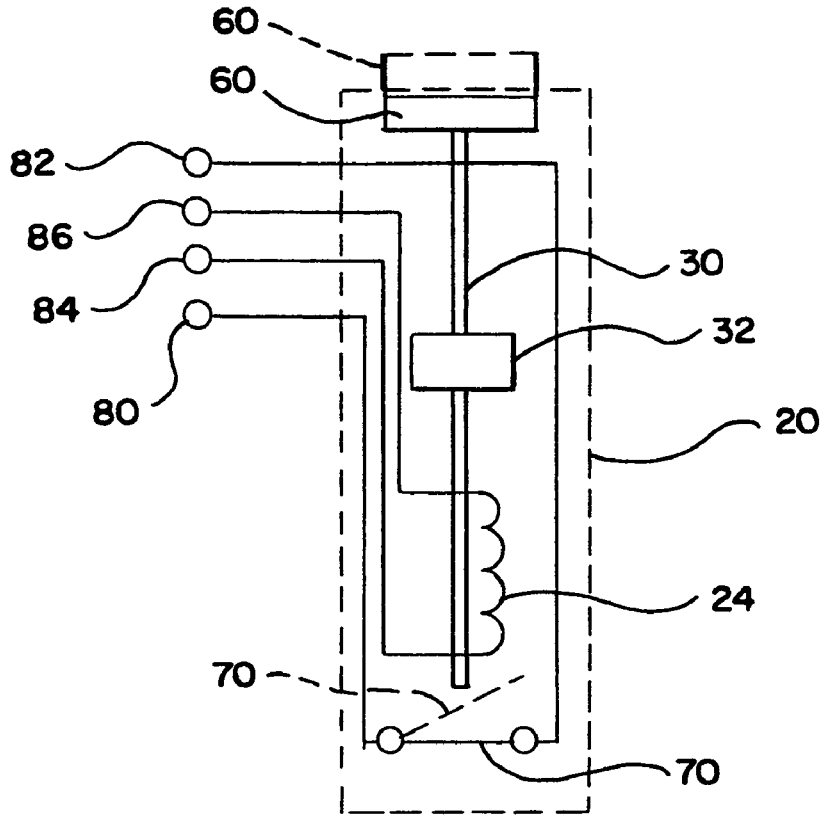
FIG. 6 is an electrical schematic of the miniature fault indicator.

The foot portion 98 of the plunger 30 may bear downwardly on an upper surface 112 of the magnet carrier 76 when the plunger is in a first, lowered or reset position. In the reset position, the reed switch magnet 78 is positioned close to the auxiliary reed switch 70 so as to be in magnetic communication causing the reed switch to be closed. In the reset position, the indicator button 60 is recessed within the top cap 50, as shown in FIG. 4, and the coiled spring 74 is compressed. The reset position is maintained against the biasing force of the coiled spring as well as forces from various parameters, such as vibration, gravity, shock and movement, by the latching of the latching magnet 32 to the core 22. When the plunger is in a second, raised or set position, the coiled spring 74 pushes the reed switch magnet 78 away from the reed switch 70 and out of magnetic communication causing the reed switch to open, and the indicator button is in a raised or extended position against the back drop wall 52 of the top cap 50. The set position is maintained with the help of the coiled spring against the same types of forces previously mentioned by the latching of the latching magnet 32 to the latching plate 36.

The plunger and latching magnet combination is linearly movable between the raised and lowered latching positions. In the lowered or reset position, the core 22 is not magnetically energized by the coil 24 so that the latching magnet 32 is latched to the core and the foot portion 98 of the plunger 30 presses downwardly on the carrier 76 of the reed switch magnet 78 so that the reed switch 70 is electrically closed. When an electrical fault signal is received by the coil 24, the core 22 is energized and exhibits a magnetic polarity which is the same as the polarity of the latching magnet 32. This causes the latching magnet 32 to be repelled by the core 22 which causes the plunger 30 to move linearly to the raised set position. Simultaneously, the foot portion 90 of the plunger 30 is lifted upwardly allowing the coiled spring 74 to bias the reed switch magnet 78 away from the reed switch 70 allowing the reed switch to electrically open. This opens any external electrical circuit with which the reed switch is in series.

It is to be noted that the miniature fault indicator 10 may be placed in any attitude; the terms such as "raised", "lowered", "upward" and "downward" are used herein as a convenience and in relation to the drawing figures bit is not to be considered limiting. The locator 34 aligns the plunger 30 and helps keep the plunger in position even when the plunger is exposed to vibration, shock and high G forces. The spacers 42, 46 determine the air gap between the latching magnet 32 and the latching structure, the core 22 and the latching plate 36. The carrier 76 is constructed so as not to rotate. The reed switch is preferable to other switches because it is capable of handling larger current loads. However, another type of switch may be used or no switch at all.

The latching magnet may be formed of samarium cobalt, have an outer diameter of about 0.160 inches, a magnetic field of about 900 gauss and weigh about 0.12 grams. The plunger may be of non-magnetic phosphor bronze alloy having a head portion diameter of about 0.091 inches, a support portion diameter of about 0.063 inches, a shaft portion diameter of about 0.045 inches and a foot portion diameter of about 0.063 inches. The plunger may weigh about 0.37 grams. The latching plate may be made of cold rolled steel and have an outside diameter of about 0.188 inches. The reed switch magnet may be made of Alnico 8 and have a magnetic field of about 350 gauss. The indicator button may have an outer diameter of about 0.250 inches, be formed of aluminum and weigh about 0.09 grams. The screw fastener may be formed of stainless steel and weigh about 0.06 grams. The upper spacer may have a thickness of about 0.010 inches and the lower spacer may have a thickness of about 0.020 inches. The outer housing may be brass. The coiled spring may be formed of non-magnetic beryllium copper with a wire diameter of about 0.008 inches and a biasing force when compressed of about 5 to 8 grams.

The electrical signal to energize the coil may be generated by any one of a number of devices which react to any one of many parameters such as temperature, light, pressure, voltage, current, humidity and chemicals. The electrical signal causes the latching magnet to be repelled and the plunger to be extended so as to expose the indicator button. A popped-up button provides a visual indication that the electrical signal has been generated. Typically the electrical signal is a fault signal and thus, the indicator button provides visual notification of a fault or problem. Simultaneously, the movement of the plunger causes the reed switch to open. If the reed switch is in series with a circuit causing the fault, for example that circuit will be broken. The reed switch may also be in series with the circuit of the electrical signal so as to open the circuit providing energy to the coil. When the core is no longer energized, a repulsion force on the latching magnet ceases.

It is an important feature of the present invention that the latching magnet and the plunger are restrained in both the retracted and the extended positions, either by the electrical signal or until a manual reset. Thus, the combination of the magnetic attraction between the latching magnet and the latching plate, in addition to the biasing force of the coiled spring, maintains the plunger in an extended or set position exposing the indicator to visual inspection. In a like manner, after manual reset, the magnet attraction of the latching magnet and the core is sufficient to latch the plunger in a retracted or reset position overcoming the biasing force of the coiled spring. Operational readiness of a system may be indicated by the "no fault" retracted, reset position and operational non-readiness may be indicated by the "fault" extended, set position.

It is also a major advantage of the disclosed fault locating, mechanical reset indicators that the set and reset latching positions are maintained even in harsh environments or under severe operating conditions, such as extreme temperatures, humidity, shock, vibration and high G forces that may be experienced by a high performance military aircraft and to a lesser extent by a commercial airliner. For example, the operating temperature range of the miniature latching indicator 10 is about −40° C. to about +105° C. between altitudes of about −15,000 feet to about +45,0000 feet, a vibration of up to 4.9 GRMS, a mechanical shock of up to 15 Gs. Under these conditions, there should be no false transfer between fault and no fault positions.

An important feature of the miniature fault indicators disclosed here is that the very low weight of the plunger/magnet, the latching forces and the mounting of indicator parts enables the indicator to withstand high shock, vibrations and G forces. G force, or gravitational force, is a function of the mass of an object so that a lighter plunger is advantageous.

The electrical specifications of the miniature fault indicator 10 include a voltage of about 28 Vdc or 115 Vac 400 Hz (half wave rectified), a current of about 500 mA with a resistance of about 65 to 240 Ohms. The insulation resistance is greater than 100 megohms per MIL-STD-202, method 301, when 500 Vdc is applied between the closed switch and the housing; 500 Vdc when applied between the coil and the housing; and 500 Vdc when applied between the closed switch and the coil. The dielectric withstanding voltage (DWV): a leakage current of less than one mA when 1,250 Vrms 60 Hz is applied between the switch and the housing; 1,250 Vrms 60 Hz is applied between the switch and the coil; and 600 Vrms is applied between the coil and the housing. The electrical specification of a preferred dc indicator may have a voltage rating of about 28 Vdc, a current rating of 500 mA and a coil resistance of 65–90 Ohms. For an ac indicator, the electrical specifications include a voltage rating of 115 Vac 400 Hz, a current rating of 500 mA and a coil resistance of 170–240 Ohms.

Waterproofness meets RTCA/DO160D section 10 Cat. W; random vibration: 3-axes, 5 hours per axis, 4.9 GRMS (10 Hz–2 kHz); shock: ½ sine pulse, 15 g peak, 11 msec, each direction of three mutually perpendicular axes. All other appropriate Military Performance Specifications are met.

Figure 7:
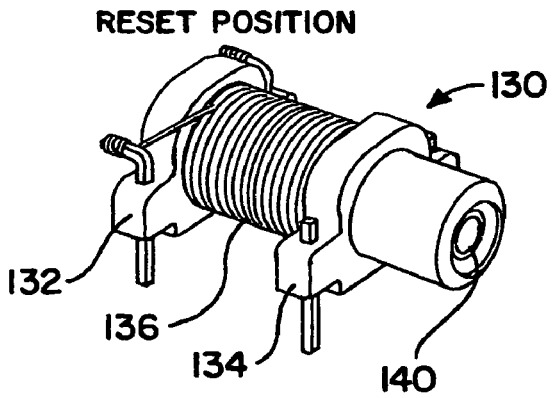
FIG. 7 is an isometric view of another embodiment of a miniature fault indicator in a reset position.
Figure 8:
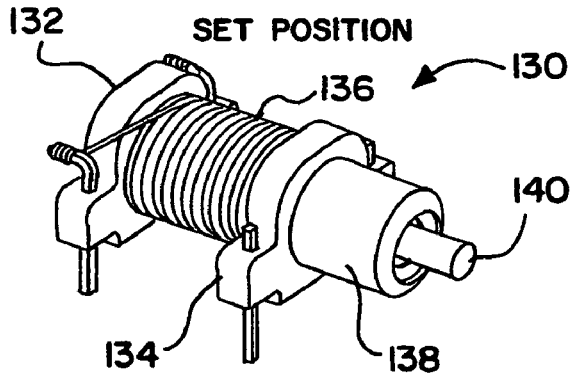
FIG. 8 is an isometric view of the miniature fault indicator embodiment shown in FIG. 7 in a set position.

A second embodiment of a miniature fault indicator is illustrated in FIGS. 7 and 8. A miniature fault locating indicator 130 may include front and rear frames 132, 134 supporting a coil 136 around a core (not shown), and a housing 138 supporting a plunger/indicator 140 with a latching magnet (not shown). There is no reed switch, second magnet or coiled spring; however, two spacers (not shown) and a latching plate (not shown) are incorporated in the housing 138. Operation is the same as for the first embodiment illustrated in FIGS. 1–5. In the reset position shown in FIG. 7, the latching magnet is magnetically latched to the core and the plunger is retracted. When the core is energized by an electrical signal, the core repels the latching magnet and the plunger moves to the extended set position as shown in FIG. 8.

The length of the indicator shown in FIGS. 7 and 8 may be about 0.886 inches, the plunger may have a stroke of about 0.15 inches, a width of about 0.5 inches and a depth of about 0.375 inches. The coil may have a length of about 0.400 inches and a width of about 0.375 inches.

In the embodiment shown in FIGS. 1–5, the button may be colored white against a black housing. In the embodiment shown in FIGS. 7 and 8, the end of the plunger indicator may be red against a white housing 138. The white strip of the embodiment shown in FIGS. 1–5 may be about 0.050 inches and the back drop wall about 0.055–0.075 inches high.

The above specification describes in detail two preferred embodiments of the present invention. Other examples, embodiments, modifications and variations will, under both the literal claim language and the doctrine of equivalents, come within the scope of the invention defined by the appended claims. For example, there is no need for a reed switch or for any switch at all. The indicator may operate without the switch, the coiled spring and the reed switch magnet. Or, other types of switches may be used. These are considered equivalent structures and will also come within the literal language of the claims. Still other alternatives will also be equivalent as will many new technologies. There is no desire or intention here to limit in any way the application of the doctrine of equivalents nor to limit or restrict the scope of the invention.

The invention claimed is:

1. A miniature, lightweight latching indicator comprising an housing;

an electromagnetic structure in electrical communication with an external circuit and adapted to receive an electrical signal, said electromagnetic structure being mounted to said housing and including a first latching structure;

a second latching structure mounted in said housing and being spaced from said first latching structure;

a permanent magnet linearly movable in said housing between a first position where said permanent magnet is in magnetic communication with said first latching structure and, in response to the electrical signal, to a second position where said permanent magnet is in magnetic communication with said second latching structure; and an indicator connected to said permanent magnet, said indicator being retracted in said housing where said indicator is not readily visible when said permanent magnet is in the first position and said indicator extending from said housing where said indicator is readily visible when said permanent magnet is in the second position.

2. The indicator of claim 1 including:

a first spacer located between said permanent magnet and said first latching structure; and a second spacer located between said permanent magnet and said second latching structure.

3. The indicator of claim 2 wherein:

said first and said second spacers are formed of non-magnetic material.

4. The indicator of claim 2 including:

an elongated plunger for supporting said permanent magnet and said indicator.

5. The indicator of claim 4 wherein:

said plunger is supported in said electromagnetic structure.

6. The indicator of claim 5 wherein:

said plunger includes a head portion and a reduced diameter shaft.

7. The indicator of claim 1 wherein said indicator includes an outer surface having a color contrasting with a color of said housing.

8. The indicator of claim 1 including:

a first spacer located between said permanent magnet and said first latching structure;

a second spacer located between said permanent magnet and said second latching structure; and an elongated plunger for supporting said permanent magnet and said indicator, said indicator having an outer surface having a color contrasting with a color of said housing.

9. The indicator of claim 8 wherein:

said first and said second spacers are formed of non-magnetic material.

10. The indicator of claim 9 wherein:

said plunger is supported in said electromagnetic structure.

11. The indicator of claim 10 wherein:

said plunger includes a reduced diameter shaft.

12. The indicator of claim 1 including:

a switch operatively connected to said permanent magnet.

13. The indicator of claim 12 including:

a spring for biasing said permanent magnet toward said second latching structure.

14. The indicator of claim 13 wherein:

said switch is a reed switch spaced from said electromagnetic structure; and including:

a second permanent magnet for operating said reed switch.

15. The indicator of claim 14 wherein:

said spring biases said second permanent magnet away from said reed switch.

16. The indicator of claim 15 wherein said reed switch is in electrical communications with the electrical signal to cause said electrical signal to be disrupted.

17. The indicator of claim 1 wherein:

said latching indicator functions within a temperature range of −40° C. to about +105° C., a vibration range up to about 4.9 GRMS, and a mechanical shock of up to 15 Gs.

18. The indicator of claim 17 wherein:

said latching indicator has a length of about 1.38 inches, a width of about 0.315 inches and a depth of about 0.335 inches and a weight of about 0.35 ounces.

* * * * *